US005910974A

United States Patent [19]

Kuhn et al.

[11] Patent Number: 5,910,974

[45] Date of Patent: Jun. 8, 1999

[54] METHOD FOR OPERATING AN X-RAY TUBE

[75] Inventors: Helmut Kuhn, Weissenbrunn; Walter Doerfler, Lonnerstadt; Gerhard Loew, Baiersdorf; Bernhard Ciolek, Stein, all of Germany

[73] Assignee: Siemens Aktiengesellschaft, Munich, Germany

[21] Appl. No.: 08/943,790

[22] Filed: Oct. 3, 1997

Related U.S. Application Data

[62] Division of application No. 08/616,285, Mar. 15, 1996, Pat. No. 5,742,662.

[30] Foreign Application Priority Data

Mar. 20, 1995 [DE] Germany ..... 195 10 048.4

[51] Int. Cl.[6] ..... H01J 35/06

[52] U.S. Cl. ..... 378/138; 378/136

[58] Field of Search ..... 378/121, 113, 378/136, 138

[56] References Cited

U.S. PATENT DOCUMENTS

| | | | |
|---|---|---|---|
| 4,344,011 | 8/1982 | Hayashi et al. . | |
| 4,689,809 | 8/1987 | Sohval . | |
| 5,033,072 | 7/1991 | Fournier et al. . | |
| 5,742,662 | 4/1998 | Kuhn et al. | 378/138 |

FOREIGN PATENT DOCUMENTS

| | | |
|---|---|---|
| 0 115 731 | 8/1984 | France . |
| 2 650 703 | 2/1991 | France . |
| 151237 | 4/1903 | Germany . |
| 30 01 141 | 7/1981 | Germany . |
| 43 04 142 | 8/1993 | Germany . |
| 59-94348 | 10/1983 | Japan . |

*Primary Examiner*—David P. Porta
*Attorney, Agent, or Firm*—Hill & Simpson

[57] ABSTRACT

An x-ray tube has an anode and a cathode arrangement mounted at a distance from the anode and having an electron emitter, the cathode arrangement containing structure for focusing the electron beam that emanates from the electron emitter during operation of the x-ray tube and which is incident on the anode in a focal spot, the focus of the electron beam being located between the electron emitter and the focal spot.

6 Claims, 5 Drawing Sheets

METHOD FOR OPERATING AN X-RAY TUBE

This is a division, of application Ser. No. 08/616,285 filed Mar. 15, 1996 now U.S. Pat No. 5,742,662.

BACKGROUND OF THE INVENTION

1. Field of the Invention

The present invention is directed to method for operating an x-ray tube of the type having an anode and a cathode arrangement mounted at a distance from the anode and including an electron emitter, the cathode arrangement containing focusing means for the electron beam that emanates from the electron emitter during operation of the x-ray tube, and which is incident on impinges the anode in a focal spot.

2. Description of the Prior Art

Such x-ray tubes of the above general type (see, for example, European Application 0 210 076) are utilized in x-ray imaging systems. In conventional x-ray tubes, an intensity distribution of the x-radiation arises in the focal spot with two humps (peaks). Such an intensity distribution, first, has a negative influence on the modulation transfer function that determines the image quality (with respect thereto, see A. Gebauer et al., "Das Röntgenfemsehen, Georg Thieme-Verlag, Stuttgart, 1974, pages 26 through 33). Added thereto is that the power density, and thus the temperature of the anode is especially high in the region of the two humps in the focal spot. A more favorable curve of the modulation transfer function as well as a maximum temperature of the anode that is theoretically about 10% lower (or a corresponding increase in the power given the same maximum temperature) could be achieved with an intensity distribution similar to a Gaussian curve.

X-ray tubes of this type are also disclosed in European Application 0 115 731, French Patent 26 50 703, U.S. Pat. No. 4,689,809, German OS 43 04 142 and German OS 30 01 141. In these known x-ray tubes a cathode head with a channel that accepts the electron emitter is provided as the electron beam focusing means, the walls thereof that reside opposite one another being chargeable with different potentials in the first three publications in order to enable a dislocation of the focal spot on the incident surface of the anode. By contrast thereto, focal spots of different size are capable of being set in the last two publications. In German OS 30 01 141, this is achieved by a sub-division of the cathode head into a plurality of sections in the longitudinal direction of the channel, these sections being chargeable with different potentials. In German OS 43 04 142, the electron emitter is divided into an uneven number of sections, with either only the middle section being active or pairs of outer sections corresponding to one another being also active.

Focal spots of different size can also be realized in an x-ray tube of the type initially described in German Patent 151 237, by means of two electron emitter sections that are axially displaceable relative to one another and either only the inner, circular section being active, or the outer annular section also additionally active dependent on the displacement position. A focusing of the electron beam is thereby achieved by a concave mirror-like curvature of the electron emitter sections.

SUMMARY OF THE INVENTION

It is an object of the present invention to provide method for operating an x-ray tube of the type initially described such that a focal spot having an intensity distribution similar to a Gaussian curve is produced.

This object is inventively achieved in a method for operating an x-ray tube having an anode and a cathode arrangement mounted at a distance from the anode an having an electron emitter, including the steps of disposing the electron emitter in a focusing channel, having at least one wall, focusing the electron beam to a focus at a distance from a focal spot on the anode, and placing at least one wall of the focusing channel at an electrical potential which sets a position of the focus and varying the electrical potential so as to vary the distance of the focus from the focal spot so as to always maintain the focus of the electron beam between the electron emitter and the focal spot.

It has been found that an intensity distribution similar to a Gaussian curve is produced in the focal spot given such a design of the focusing means. The term "focus" as used herein means the principal focus, i.e., the focus of those portions of the electron beam that determine the intensity of the focal spot and that usually emanate from those regions of the electron emitter immediately adjacent to the anode. With respect to portions of the electron beam that are not critical to the intensity of the focal spot and that emanate from regions of the electron emitter that face more or less away from the anode, for example from the back side thereof, secondary foci of noticeably lower intensity which deviate from the principal focus can be present. Dependent on the shape of the electron emitter and on the action of the focusing means, the focus can be a substantially punctiform or at least an approximately line-shaped focus. The Gaussian curve-like intensity distribution is present only transversely relative to the line focus in the case of a line focus.

In a preferred embodiment a flat emitter is provided as the electron emitter. A further approximation to a Gaussian curve-shaped intensity distribution of the x-radiation in the focal spot can thus be achieved since a focal spot generated with a flat emitter is much closer to the Gaussian curve-shaped ideal than, for example, a focal spot generated with a helical electron emitter. As used herein, "a flat emitter" means an electron emitter whose region provided for electron emission represents a substantially planar surface. It is unavoidable in practice, however, that electrons are also emitted outside the planar surface provided for electron emission; this part of the electron emission, however, is of subordinate significance in practice. It can nonetheless lead to undesirable deviations from the desired intensity distribution in the focal spot. It is therefore especially beneficial when the flat emitter is coated such that the emission of electrons ensues substantially exclusively in the region of the surface of the flat emitter facing toward the anode. This can be achieved either by coating the surface provided for emission with a material having a higher electron emission capability compared to the material or materials present at the other surface of the flat emitter, and/or by coating the flat emitter with a material outside of the surface provided for electron emission having a lower electron emission capability compared to the material present in the area provided for electron emission.

According to a version of the invention, the electron emitter is accepted in a focusing channel (also referred to in the art as focusing groove) of the focusing means. At least one of the walls of the focusing channel is placed at a potential that influences the position of the focus. The focusing channel is preferably stepped, particularly given the use of a flat emitter, such that the step adjacent to the anode is broader than the step remote from the anode, with the flat emitter being arranged in the region of the transition from the step remote from the anode into the step adjacent to the anode. According to embodiments of the invention, at least one step of the focusing channel can have a rectangular cross-section and/or at least one step of the focusing channel can have a trapezoidal cross-section with walls diverging in the direction toward the anode.

In another embodiment of the invention, the focusing channel is limited by two pairs of walls lying opposite one another that are electrically insulated from one another, the walls of the one pair being at a first electrical potential and those of the other pair being at a second electrical potential, with the electrical potential with respect to at least one pair being selected such that the corresponding focus is located between the electron emitter and the focal spot. There is thus the possibility of selecting the position of the focus in two directions independently of one another, for example in the direction of the length and in the direction of the width of the focal spot.

The invention has a further object of permitting adjustment of the size of the focal spot in a simple way while retaining the Gaussian curve-like intensity distribution of the x-radiation in the focal spot. According to one embodiment of the invention, this further object is achieved by means for varying the distance of the focus of the focusing means and thus the focus of the electron beam from the focal spot. This measure is based on the perception that the distance of the focus from the focal spot is the determining factor for the size of the focal spot, with the focal spot increasing in size as the distance of the focus from the focal spot increases. Since the focus is located between the electron emitter and the focal spot regardless of what focal spot size has been set, a Gaussian curve-like intensity distribution in the focal spot is assured independently of the focal spot size that is set.

The position of the focus can be adjusted by varying the potential which influences the position of the focus, or by varying the first and/or the second potential. There is also the possibility of influencing the position of the focus by adjusting the position of the electron emitter in the focusing channel in the direction of the middle axis of the electron beam.

Given electrical adjustment, it can be provided that the first and the second potentials are variable independently of one another for that case wherein the first as well as the second potential are variable.

DESCRIPTION OF THE PREFERRED EMBODIMENTS

Figure 1:
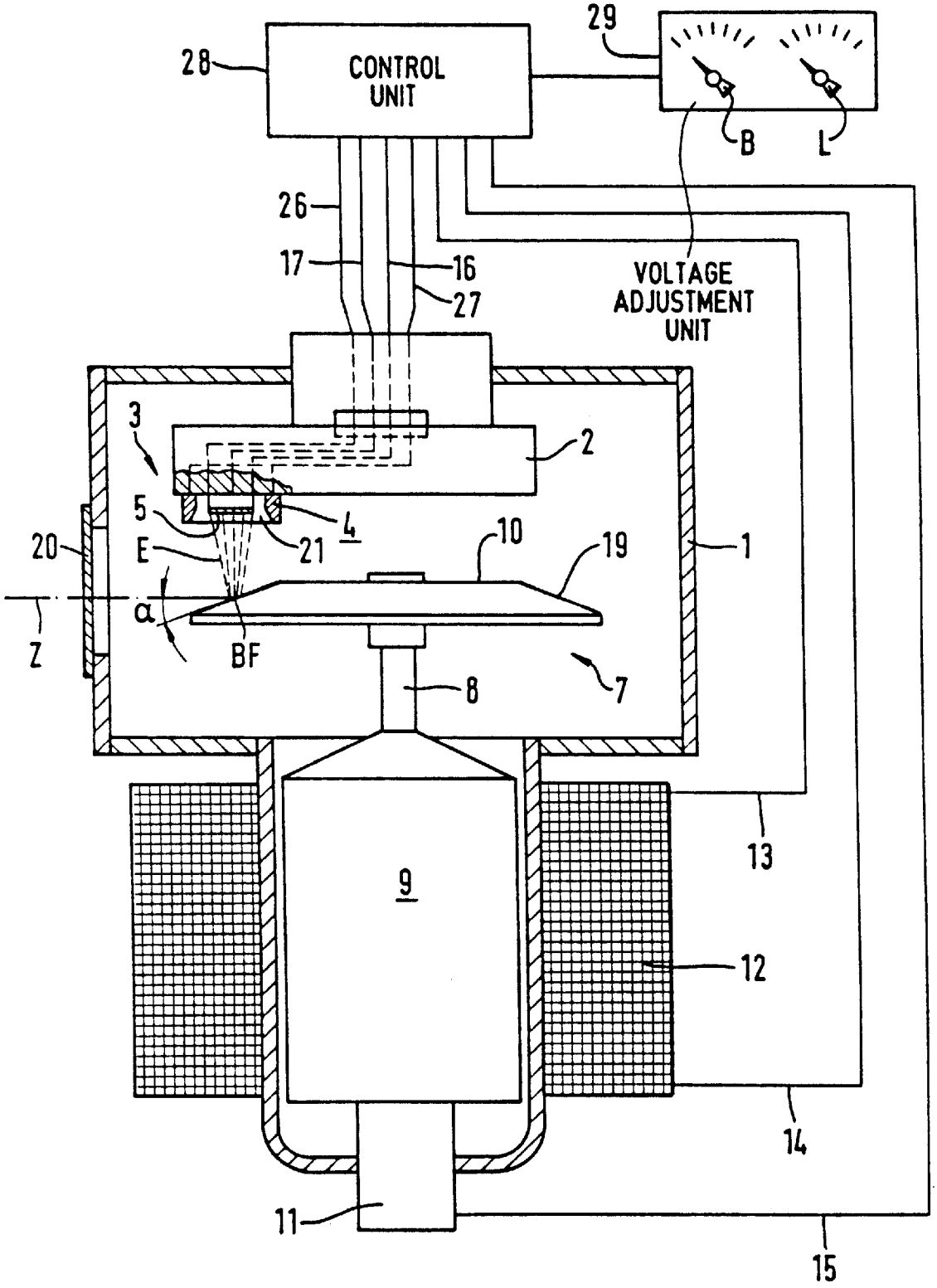
FIG. 1 is a longitudinal section through an inventive x-ray tube, shown schematically.

The x-ray tube shown in FIG. 1 has a bulb 1 that is manufactured in a known way of metal and ceramic or glass—other materials are possible. A cathode arrangement 3 is attached to a carrier part 2 inside the bulb 1, the cathode arrangement 3 being an electron emitter in the form of a glow cathode 5 accepted inside a cathode member 4 provided as a focusing means. A rotating anode generally referenced 7 includes an anode dish 10 connected to a rotor 9 via a shaft 8, opposite the glow cathode 5. In a known way not shown in FIG. 1, the rotor 9 is rotatably seated on an axle 11 connected to the bulb 1. A stator 12 that interacts with the rotor 9 to form an electric motor serving the purpose of driving the rotating anode 7 is disposed on the outside wall of the bulb 1 in the region of the rotor 9.

During operation of the x-ray tube, an alternating current is supplied to the stator 12 via lines 13 and 14, so that the anode dish 10 connected to the rotor 9 via the axle 11 rotates.

The tube voltage is applied via lines 15 and 16, the line 16 being connected to a terminal of the glow cathode 5. The other terminal of the glow cathode 5 is connected to a line 17 via which a filament current is supplied. When this occurs, an electron beam emanates from the glow cathode 5.

As indicated with broken lines in FIG. 1, this [electron beam] is incident onto an incident surface 19 of the anode dish 10 in a focal spot referenced BF. The x-radiation emanating from the focal spot BF emerges through a beam exit window 20.

Figure 2:
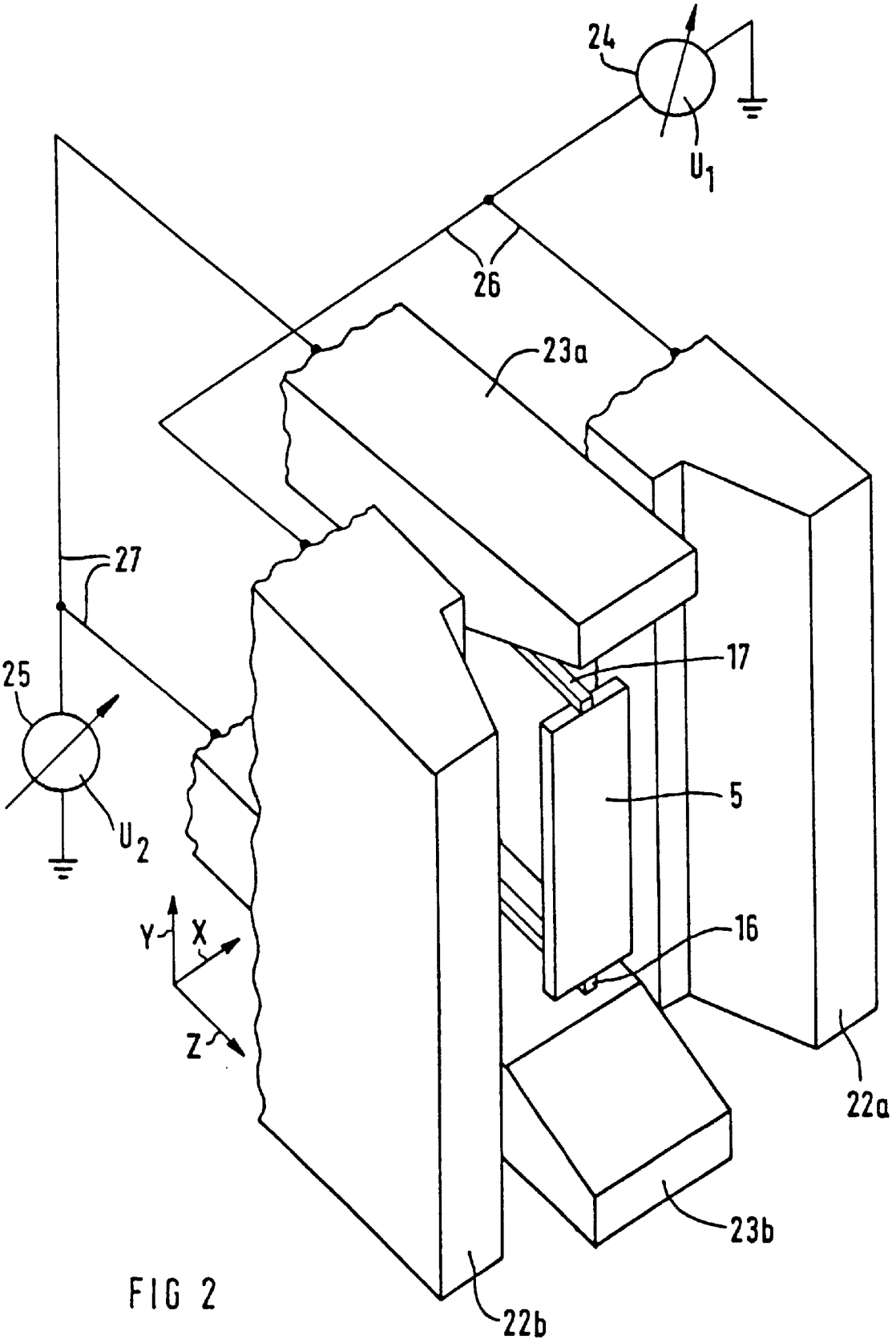
FIG. 2 is a perspective view of the basic parts of the cathode arrangement of the x-ray tube of FIG. 1.

As can be seen from FIGS. 1 and 2, the glow cathode 5 is a flat emitter that is accepted in a stepped focusing channel 21 of the cathode member 4.

The cathode member 4 has four wall parts 22*a*, 22*b* and 23*a*, 23*b* that limit the focusing channel 21. The wall parts 22*a* and 22*b*, and 23*a* and 23*b*, are respectively arranged lying parallel opposite one another.

The wall parts 22*a* and 22*b* are at a common potential $U_1$ and the wall parts 23*a* and 23*b* are at a common potential $U_2$. To that end, they are connected to respective voltage sources 24 and 25 via lines 26 and 27. In a way not shown in FIGS. 1 and 2, the wall parts 22*a* and 22*b* are electrically insulated from the wall parts 23*a* and 23*b*.

Figure 3:
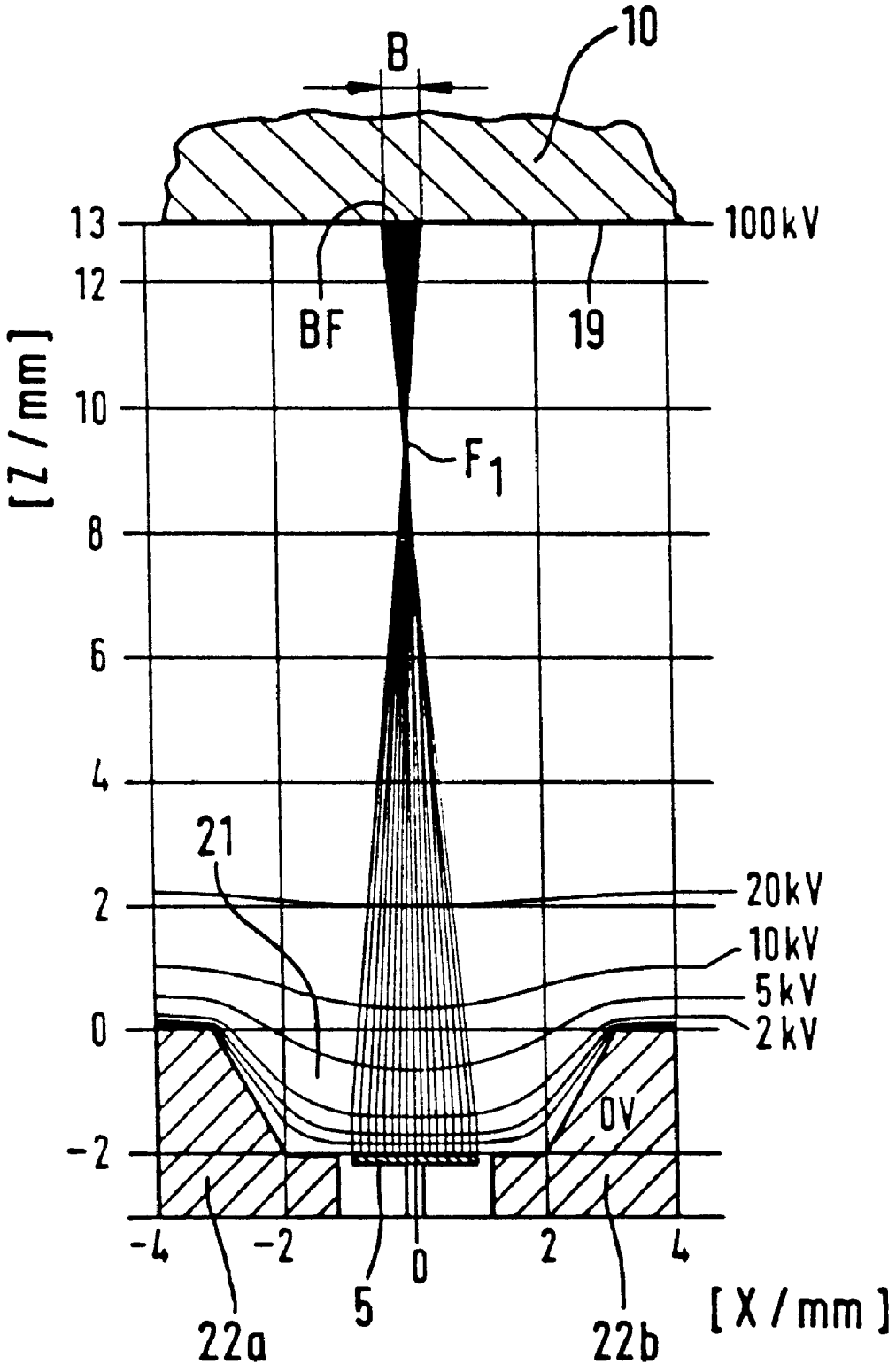
FIGS. 3 and 4 illustrate electrical field lines and electron paths showing the functioning of the x-ray tube of FIGS. 1 and 2.

The potential $U_1$ at the walls parts 22*a* and 22*b* neighboring the longer sides of the flat emitter is selected such that the electron beam emanating from that side of the flat emitter facing toward the anode dish 10 is focused so that the focus $F_1$ lies between the flat emitter and the focal spot BF (see FIG. 3).

As a result of this measure, an intensity distribution of the x-rays emanating from the focal spot that is similar to a Gaussian curve and that is beneficial for the reasons initially set forth is produced viewed transversely relative to the direction of the longitudinal axis of the flat emitter. This intensity distribution is more closely approximated to the Gaussian curve ideal as a consequence of the fact that the focus $F_1$ lies between the flat emitter and the focal spot BF than would be the case if the focus $F_1$, as is standard in known x-ray tubes, were to lie on the other side of the focal spot BF as viewed from the flat emitter, i.e. within the anode dish 10.

In order to be able to vary the width B of the focal spot BF, the potential at which the wall parts 22*a* and 22*b* lie can be shifted. To this end, the potential supplied by the voltage source 24 can be adjusted, this being indicated in FIG. 2 with an adjustment arrow, such that positive as well as negative potentials can be set.

With increasingly positive potential $U_1$, the focus $F_1$ migrates in the direction toward the focal spot BF, whose width consequently becomes smaller. With increasingly negative potential $U_1$, the focus $F_1$—proceeding from the position shown in FIG. 3—migrates in the direction toward the flat emitter, with the result that the width B of the focal spot BF increases.

Figure 4:
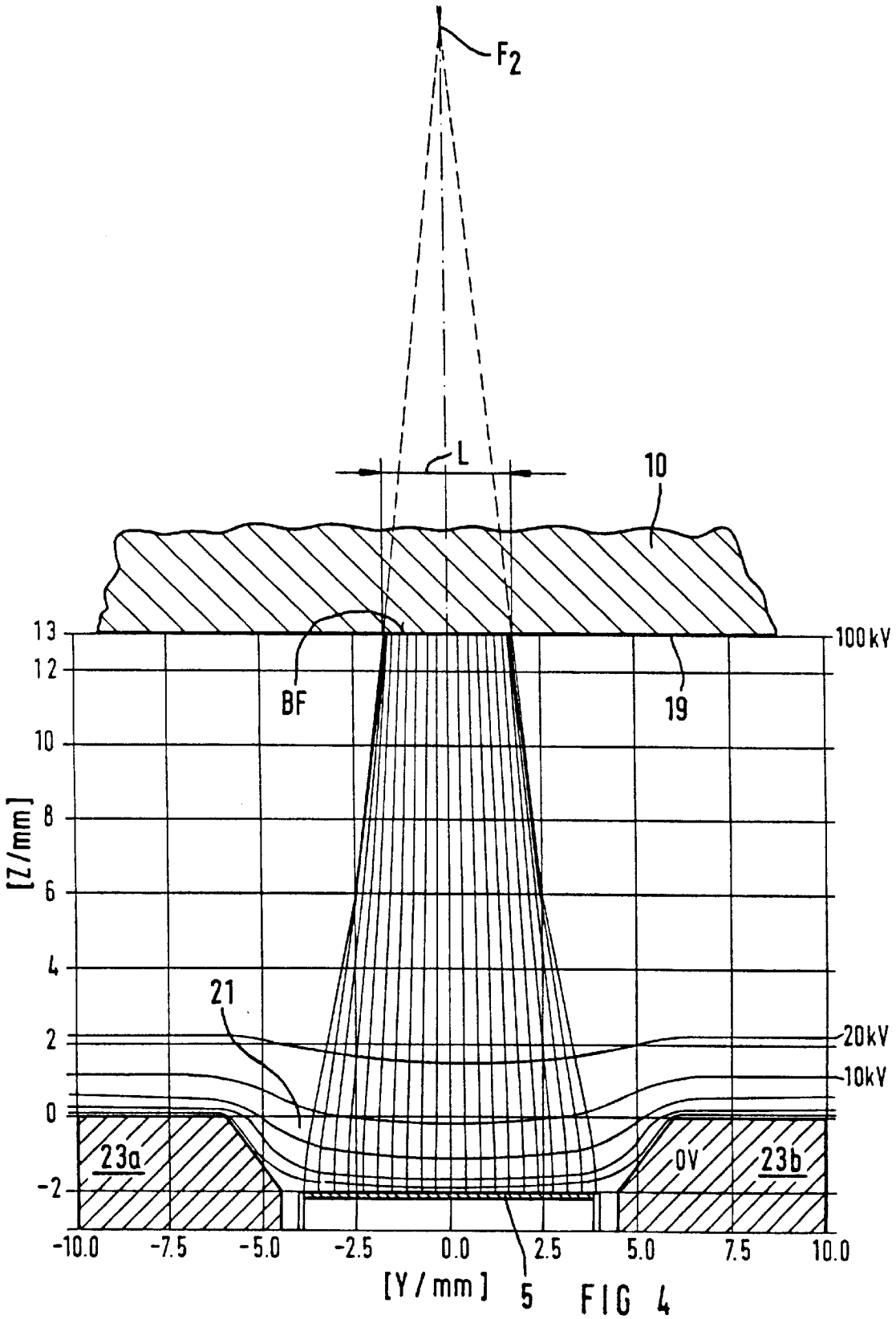

The focus $F_2$ belonging to the wall parts 23*a* and 23*b* adjacent the narrow sides of the emitter lies within or beyond the anode dish 10, as shown in FIG. 4, when the wall parts 23*a* and 23*b* lie at a potential $U_2$ of 0 volts. Viewed in the direction of the longitudinal axis of the flat emitter, an intensity distribution of the x-radiation in the focal spot BF is produced that is less well-approximated to the Gaussian curve ideal. This is of less significance since the longitudinal axis of the focal spot BF and the central ray Z of the x-ray beam of FIG. 3 emanating from the focal spot BF describe an acute angle a as a result of the conic frustum shape of the incident surface of the rotating anode 7. As viewed from an x-ray receiver, for example an x-ray film or an x-ray image intensifier, the humps in the intensity distribution of the x-radiation are thus not particularly pronounced in the longitudinal direction of the focal spot BF.

It is also possible, however, to orient the wall parts 23*a* and 23*b* so that the focus F2 lies between the focal spot BF and the flat emitter. There is also the possibility of using the wall parts 23*a* and 23*b* to displace the position of the focus F, enabling an adjustment of the length L of the focal spot BF, by adjusting potential $U_2$ for that purpose. The focal spot becomes longer the more positive the potential $U_2$ becomes (the distance of the focus $F_2$ from the flat emitter becoming greater). The length L of the focal spot BF becomes less the more negative the potential $U_2$ becomes (the focus F2 approaching the focal spot BF).

As shown in FIGS. 3 and 4, tests have shown that practically no variation of the set width B of the focal spot BF occurs when the length L of the focal spot is adjusted, and vice-versa.

The axis references indicated in FIGS. 3 and 4 refer to the coordinate axes of the Cartesian coordinate system shown in FIG. 2.

As shown in FIG. 1, the x-ray tube has a control unit 28 allocated to it that generates all voltages and currents required for the operation of the x-ray tube and that also permits adjustment of the position of the focus F, and thus of the width B and of the length L of the focal spot BF, i.e. the control unit 28 also contains the voltage sources 24 and 25. The adjustment of the dimensions of the focal spot BF can be accomplished by an operator using a voltage adjustment unit 29 connected to the control unit 28, thus unit 29 having respective a rotary knobs B and L appropriately marked for the width B and the length L of the focal spot BF. The adjustment can also ensue automatically, for example dependent on the distance that is set between the focal spot BF and the radiation receiver or between the radiation receiver and a subject. These distances determine the magnification factor.

Figure 5:
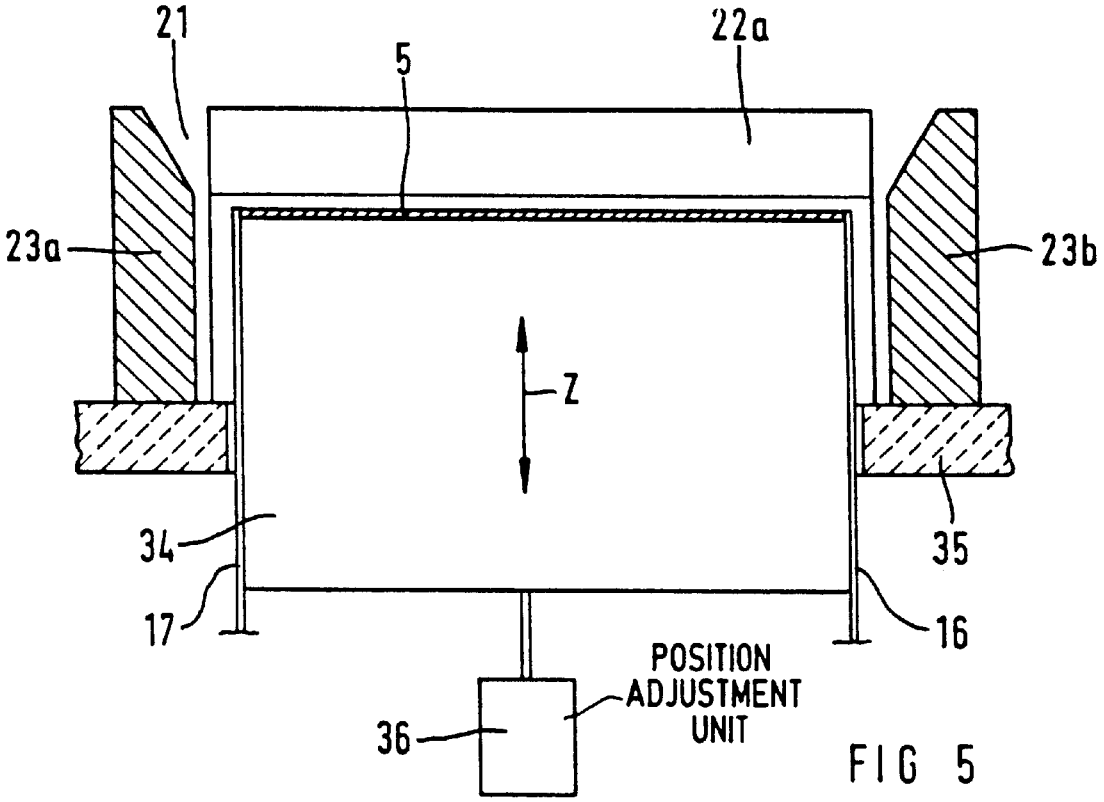
FIG. 5 is a longitudinal section through the basic parts of the cathode arrangement of a further embodiment of the inventive x-ray tube.

The exemplary embodiment of FIG. 5 differs from that set forth above by providing adjustability of the flat emitter and of the focusing unit 21 relative to one another instead of adjustability of the potentials $U_1$ and $U_2$, for the purpose of modify the depth position of the flat emitter in the focusing channel 21.

In the exemplary embodiment of FIG. 5, this is achieved by attaching the flat emitter to a ceramic part 34 that projects through an opening of a second ceramic part 35 that carries the wall parts 22*a*, 22*b* (not visible in FIG. 5) and 23*a*, 23*b*. A schematically indicated position adjustment unit 36 acts on the ceramic part 34. The position adjustment unit 36 may be, for example, a piezotranslator or oscillation (solenoid) coil similar to coil in a loudspeaker. The position adjustment unit 36 enables a straight-line adjustment of the flat emitter in the direction of the middle axis of the electron beam E. This position adjustment is indicated by a correspondingly referenced double arrow Z in FIG. 5.

Whereas the width B of the focal spot BF can be influenced very well by a displacement of the flat emitter in Z-direction, the length L of the focal spot BF remains nearly constant. When, given the exemplary embodiment of FIG. 5, the length L of the focal spot BF is also to be varied to a greater extent, it is necessary for this purpose to vary the potential $U_2$ at which the wall parts 23*a* and 23*b* lie. This is accomplished, as indicated in FIG. 5 with broken lines, by connecting the voltage source 25 to the wall parts 23*a* and 23*b* via the line 27.

The arrangement indicated with broken lines simultaneously produces the advantage that the width B and the length L of the focal spot BF are adjustable independently of one another since these adjustments respective ensue by adjusting the potential $U_2$, and by displacing the flat emitter in the Z-direction.

In both exemplary embodiments, the focusing channel 21 is stepped such that the step adjoining the rotating anode 7 is broader than the step remote from the rotating anode 7. As shown in FIG. 2, the flat emitter is arranged in the region of the transition of the step remote from the rotating anode 7 into the step adjacent to the rotating anode 7. In the region of the step remote from the rotating anode 7, the focusing channel 21 has a rectangular contour both in the longitudinal section and in the cross-section. In the region of the step adjacent to the rotating anode 7, the focusing channel 21 has a V-shaped contour both in the longitudinal section and in cross-section, this V-shaped contour expanding in the direction toward the rotating anode 7. Whereas the rectangular contour in the longitudinal section of the focusing channel 23 merges directly into the V-shaped contour, a shoulder is provided in the cross-section of the focusing channel 21.

As shown in FIGS. 2 through 4, the flat emitter or glow cathode 5 should be arranged within the narrower step remote from the rotating anode 7 (negative seat). This results in only few of the electrons emanating from the back side and from the lateral edges of the flat emitter being able to proceed to the incident surface 19. A smaller, sharper focal spot accordingly results.

For the same reason, the distance between the lateral edges of the flat emitter and the step of the focusing channel that accepts the flat emitter should be small (on the order of 0.1 through 0.3 mm).

For the same reason, the flat emitter or the glow cathode 5 should be optimally thin in order assure that only few electrons are emitted in the region of the lateral edges of the flat emitter.

Figure 6:
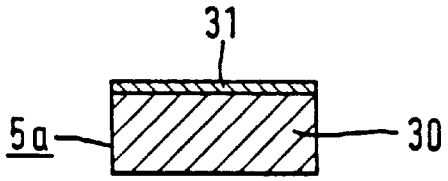
FIG. 6 is a section through an electron emitter of another embodiment of the inventive x-ray tube.

Alternatively or additionally, however, the flat emitter can be formed of a base member 30 with a coating 31 applied to the base member 30 in the region of the surface provided for the electron emission, as illustrated in FIG. 6, for example, of the glow cathode 5 fashioned as a flat emitter. The coating 31 is composed of a material that has a high electron emission capability compared to the material of the base member 30. For example, tungsten or molybdenum can be used as the material for the base member 30 and lanthanum hexaboride ($LaB_6$) can be used as the material for the coating 31.

Figure 7:
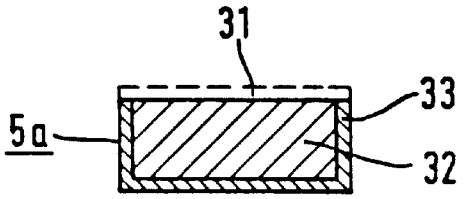
FIG. 7 is a modified version of the electron emitter shown in an illustration analogous to FIG. 6.

As in FIG. 7, likewise for the example of the glow cathode 5 fashioned as a flat emitter, there is the alternative possibility of constructing the flat emitter of a base member 32 and a coating 33 that covers the base member 32 except in the region of its surface provided for the electron emission. The coating 33 is composed of a material that has a lower electron emission capability compared to the material of the base member 32. As indicated with broken lines in FIG. 7, there is the additional possibility of providing a further coating 31 in the region of the surface provided for electron emission, this further coating 31 being formed of a material that has a higher electron emission capability compared to the material of the base member 32.

$LaB_6$, for example, is suitable as the material for the base member and tungsten or molybdenum is suitable as the material for the coating 33.

Trials were implemented with a tube constructed according to FIGS. 1 and 2 as well as with a tube constructed according to FIG. 5. In both instances, the electrode spacing amounted to 13 mm, the anode voltage to 5 kV, the filament current to 9.5 A and the tube current to a few $\mu$A. The flat emitter respectively employed in the tubes had a width of 2 mm, a length of 10 mm and a thickness of 50 $\mu$m. The width B of the focal spot BF could be adjusted between about 0.35 and about 1.3 mm by varying the potential $U_1$ between 40 and −40 V. The length L of the focal spot BF could be adjusted between 7 and 4.3 mm by varying the potential U2 between 100 and −100 V. The width of the focal spot BF could be adjusted between 0.4 and 1.5 mm by displacing the flat emitter in the Z-direction by 0.55 mm. The width B of the focal spot BF becomes larger the more deeply the flat emitter is seated in the focusing channel 21. The change in the length of the focal spot for the range of adjustment of the flat emitter was negligible.

In the trials, the intensity distribution of the x-radiation in the focal spot BF transversely relative to the longitudinal axis of the flat emitter retained a good approximation of a Gaussian curve intensity distribution independently of the width B or length L of the focal spot BF that were respectively set.

The above-described exemplary embodiments are rotating anode x-ray tubes. The invention, however, can also be employed in x-ray tubes having a fixed anode.

In the described exemplary embodiment, the electron emitter is formed by a directly heated glow cathode that generates an electron beam incident onto the incident surface in the focal spot. Other electron emitters, for example indirectly heated cathodes or electron beam guns, however, can be employed instead of glow cathodes. When a directly heated glow cathodes is employed as the electron emitter, this need not necessarily be fashioned as a flat emitters as in the case of the described exemplary embodiment. Serpentine ribbon emitters as disclosed, for example, by German OS 27 27 907 or conventional wire helices can be employed, but particularly the latter are less beneficial for the aforementioned reasons.

Although modifications and changes may be suggested by those skilled in the art, it is the intention of the inventors to embody within the patent warranted hereon all changes and modifications as reasonably and properly come within the scope of their contribution to the art.

We claim as our invention:

1. A method for operating an x-ray tube having an anode and a cathode mounted in a housing at a distance from each other, said cathode having an electron emitter, said method comprising the steps of:

emitting an electron beam from said electron emitter, said electron beam proceeding from said electron emitter to said anode and being incident on said anode in a focal spot;

placing said electron emitter in a focusing channel having at least one wall and focusing said electron beam, using said focusing channel, to a focus;

placing said at least one wall of said channel at an electrical potential which influences a position of said focus; and varying said electrical potential for varying a distance of said focus from said focal spot for always maintaining said focus between said electron emitter and said focal spot.

2. A method for operating an x-ray tube as claimed in claim 1 comprising the additional step of varying a position of said electron emitter relative to said focusing channel for adjusting a depth position of said electron emitter in said focusing channel.

3. A method for operating an x-ray tube having an anode and a cathode mounted in a housing at a distance from each other, said cathode having an electron emitter, said method comprising the steps of:

emitting an electron beam from said electron emitter, said electron beam proceeding from said electron emitter to said anode and being incident on said anode in a focal spot;

disposing said electron emitter in a focusing channel having a first pair of opposite walls and a second pair of opposite walls;

insulating said first pair of opposite walls from said second pair of opposite walls;

placing said first pair of walls at a first electrical potential and placing said second pair of walls at a second electrical potential;

using at least one of said first and second electrical potentials for focusing said electron beam to a focus at a distance from said focal spot; and varying at least one of said first and second electrical potentials for varying said distance for always maintaining said focus between said electron emitter and said focal spot.

4. A method for operating an x-ray tube as claimed in claim 3 wherein the step of varying at least one of said first and second electrical potentials comprises varying each of said first and second electrical potentials.

5. A method for operating an x-ray tube as claimed in claim 4 wherein the step of varying each of said first and second electrical potentials comprises varying each of said first and second electrical potentials independently of each other.

6. A method for operating an x-ray tube as claimed in claim 4 comprising the additional step of varying a position of said electron emitter relative to said focusing channel for adjusting a depth position of said electron emitter in said focusing channel.

* * * * *